US007748999B1

(12) United States Patent
Sun et al.

(10) Patent No.: US 7,748,999 B1
(45) Date of Patent: Jul. 6, 2010

(54) ELECTRICAL CONNECTOR

(75) Inventors: Dao-Rui Sun, Tu-Cheng (TW); Feng Zhu, Tu-Cheng (TW); Kuo-Chin Lin, Tu-Cheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/547,484

(22) Filed: Aug. 26, 2009

(51) Int. Cl.
*H01R 12/00* (2006.01)

(52) U.S. Cl. ..... 439/79; 439/607.36; 439/660

(58) Field of Classification Search ..... 439/79, 439/660, 607.35–607.4, 607.44, 607.55, 439/607.01
See application file for complete search history.

(56) References Cited

U.S. PATENT DOCUMENTS

| | | | | |
|---|---|---|---|---|
| 5,304,069 | A * | 4/1994 | Brunker et al. | 439/108 |
| 5,344,327 | A * | 9/1994 | Brunker et al. | 439/108 |
| 5,658,155 | A * | 8/1997 | McFarlane et al. | 439/79 |
| 5,931,687 | A * | 8/1999 | McFarlane et al. | 439/79 |
| 5,975,917 | A * | 11/1999 | Wang et al. | 439/79 |
| 5,980,325 | A * | 11/1999 | Horchler | 439/660 |
| 6,039,611 | A * | 3/2000 | Yang | 439/701 |
| 6,210,230 | B1 * | 4/2001 | Lai | 439/607.44 |
| 6,319,061 | B1 * | 11/2001 | Chen et al. | 439/607.15 |
| 6,609,929 | B2 * | 8/2003 | Kamarauskas et al. | 439/541.5 |
| 6,619,968 | B2 * | 9/2003 | Xu | 439/79 |
| 6,648,697 | B2 * | 11/2003 | Yang | 439/701 |
| 6,672,905 | B2 * | 1/2004 | Tharp et al. | 439/660 |
| 6,736,676 | B2 * | 5/2004 | Zhang et al. | 439/607.22 |
| 6,863,569 | B2 * | 3/2005 | Zhu et al. | 439/607.27 |
| 7,025,632 | B2 * | 4/2006 | Hu et al. | 439/606 |
| 7,182,636 | B2 * | 2/2007 | Chen | 439/541.5 |
| 7,311,556 | B2 * | 12/2007 | Wan et al. | 439/607.32 |
| 7,318,752 | B2 * | 1/2008 | Fujimoto et al. | 439/660 |
| 7,485,008 | B1 * | 2/2009 | Yi et al. | 439/660 |
| D592,145 | S * | 5/2009 | Sun | D13/147 |
| D598,390 | S * | 8/2009 | Sun et al. | D13/147 |
| 7,591,683 | B2 * | 9/2009 | Zhang et al. | 439/638 |
| 7,611,387 | B1 * | 11/2009 | Zhang | 439/660 |
| 2004/0229502 | A1 * | 11/2004 | Hu et al. | 439/541.5 |
| 2008/0176449 | A1 * | 7/2008 | Hu et al. | 439/607 |
| 2008/0305689 | A1 * | 12/2008 | Zhang et al. | 439/638 |
| 2009/0221161 | A1 * | 9/2009 | Zhu | 439/78 |
| 2009/0258514 | A1 * | 10/2009 | He et al. | 439/79 |

* cited by examiner

*Primary Examiner*—T C Patel
*Assistant Examiner*—Vladimir Imas

(57) ABSTRACT

An electrical connector has an insulating housing defining a front wall. The front wall has a mating portion defining a plurality of passageways extending frontward and rearward in a top surface and a bottom surface respectively. A first terminal module has a plurality of first conductive terminals and a first base for restraining the first conductive terminals. The first conductive terminals have contacting portions extended outside the first base and arranged side by side to form one row for being received in the passageways defined in the top surface. A second terminal module disposed under the first terminal module has a plurality of second conductive terminals and a second base for restraining the second conductive terminals. The second conductive terminals have contacting portions extended outside the second base and arranged side by side to form one row for being received in the passageways defined in the bottom surface.

20 Claims, 7 Drawing Sheets

ELECTRICAL CONNECTOR

BACKGROUND OF THE INVENTION

1. Field of the Invention

The invention relates to an electrical connector, and more particularly to an electrical connector having a simple and compact assembling structure.

2. The Related Art

Electrical connectors are widely provided in electrical devices to achieve the function that the electrical signals are conducted between different electrical devices. The conventional electrical connector includes an insulating housing, a plurality of conductive terminals received in the insulating housing and a shielding shell enclosed a periphery of the insulating housing. With the electrical devices developing towards miniaturizations and diversifications in recent years, a variety of functions integrated in the electrical connector will be preferable. For instance, an electrical connector has audio terminals and video terminals received in the insulating housing thereof, for transmitting audio signals and video signals at the same time. However, the function integration results in the complicated structure of the electrical connector, which makes the assembly become difficult and increases the manufacture cost. In this instance, it is desirable to design an electrical connector having a simple and compact assembling structure.

SUMMARY OF THE INVENTION

An object of the present invention is to provide an electrical connector having a simple and compact assembling structure. The electrical connector has an insulating housing. The insulating housing includes a rectangular top wall, two facing lateral walls connected to two opposite sides of the top wall, a front wall extended downwards from a front side of the top wall and connected with the two lateral walls, forming a receiving chamber. The front wall has a portion extended frontward to form a mating portion. The mating portion has a plurality of passageways extending frontward and rearward for communicating with the receiving chamber in a top surface and a bottom surface respectively. A first terminal module has a plurality of first conductive terminals and a first base for restraining the first conductive terminals. The first conductive terminals have contacting portions extended outside the first base and arranged side by side to form one row for being received in the passageways defined in the top surface. A second terminal module disposed under the first terminal module has a plurality of second conductive terminals and a second base for restraining the second conductive terminals. The second conductive terminals have contacting portions extended outside the second base and arranged side by side to form one row spaced from the row of the contacting portions of the first conductive terminals for being received in the passageways defined in the bottom surface. The first base is fixed on the second base to make the first terminal module and the second terminal module be received in the receiving chamber of the insulating housing at one time.

As described above, the first conductive terminals and the second conductive terminals are restrained together by the first base and the second base respectively, forming the first terminal module and the second terminal module. The first terminal module and the second terminal module are piled with each other to make the contacting portions insert into the corresponding passageways of the mating portion simultaneously, in assembly. So the electrical connector with a simple and compact assembling structure is easy to manufacture and reduces the manufacture time and cost.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
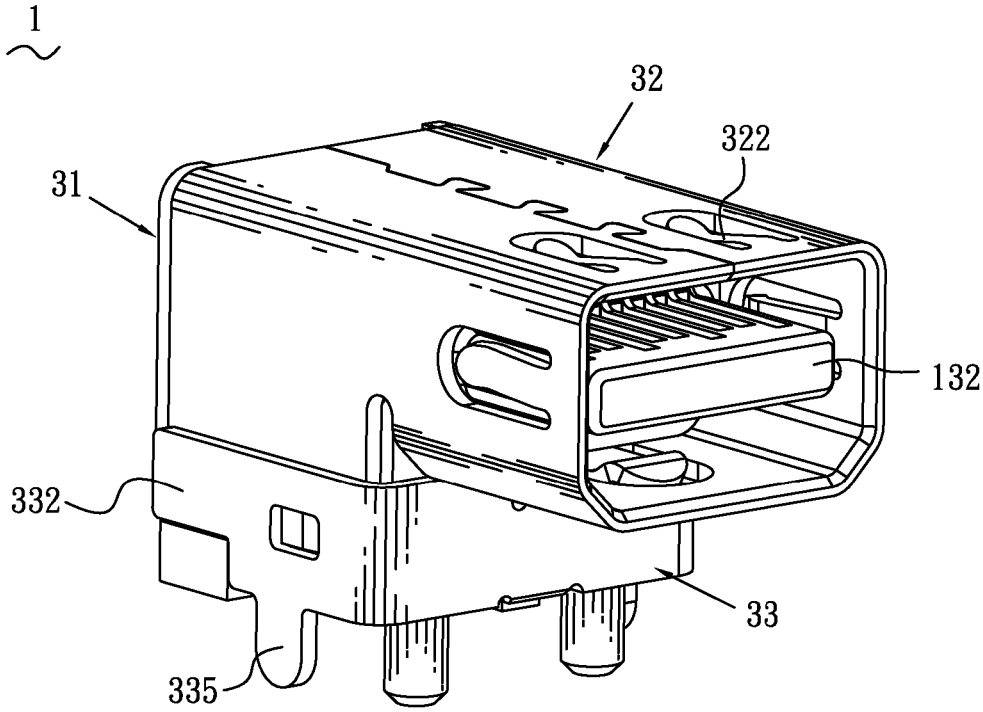
FIG. 1 is a perspective view of an electrical connector according to the present invention.
Figure 2:
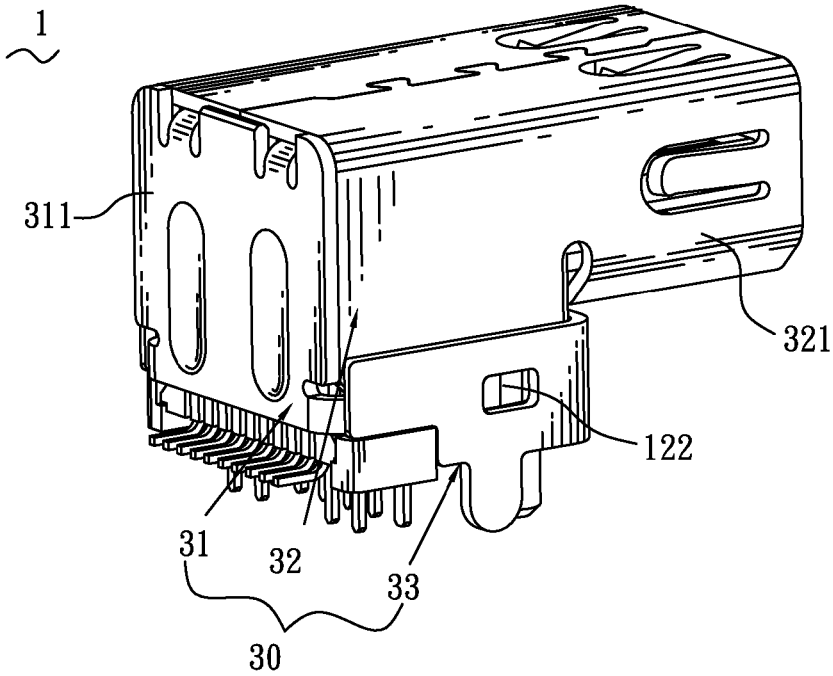
FIG. 2 is a perspective view of the electrical connector shown in FIG. 1 seen from another direction.
Figure 3:
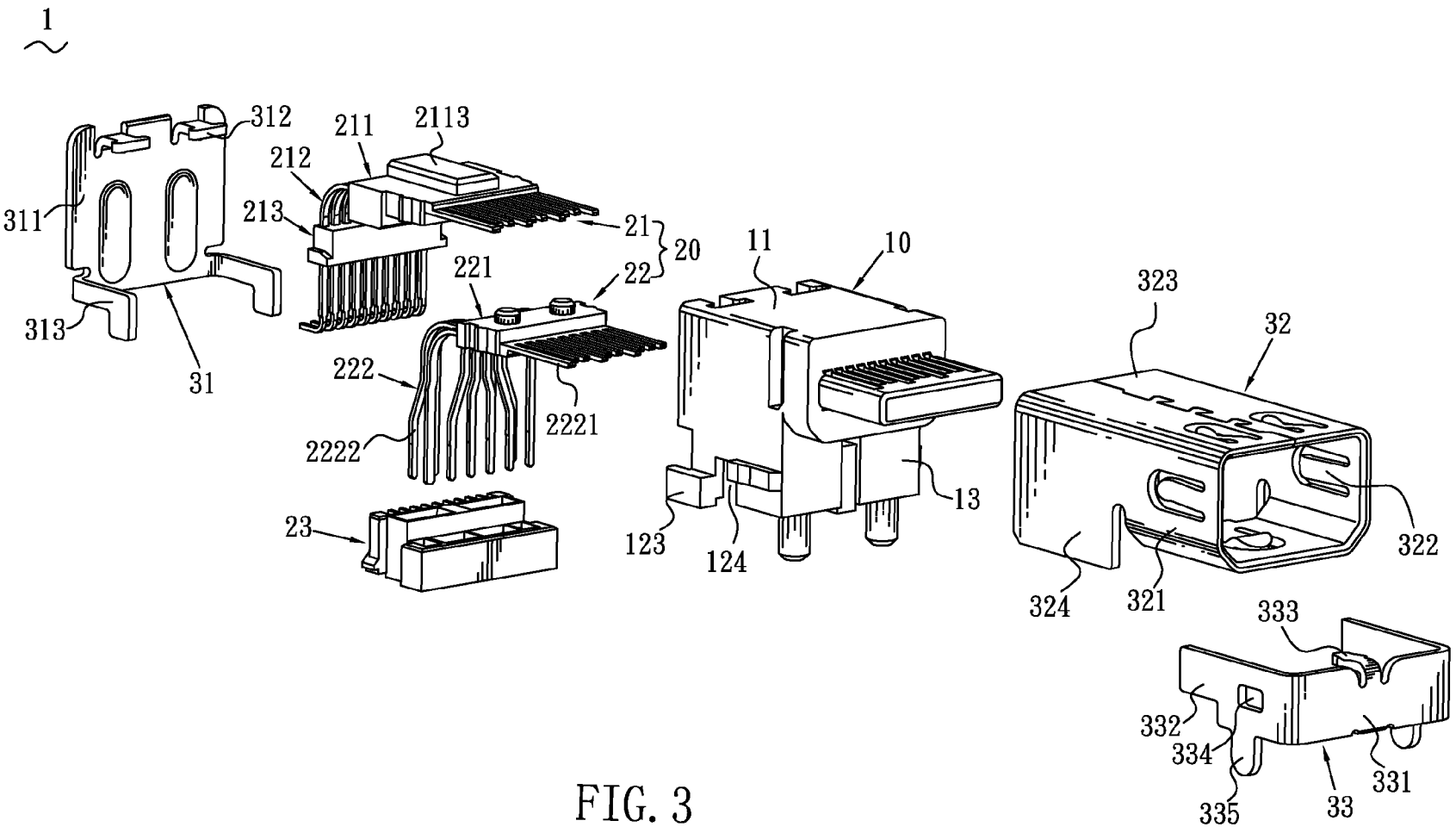
FIG. 3 is an exploded view of the electrical connector shown in FIG. 1.

Please refer to FIGS. 1-3, an electrical connector 1 according to the present invention is shown. The electrical connector 1 includes an insulating housing 10, a terminal module 20 disposed in the insulating housing 10 and a shielding shell 30 enclosed a periphery of the insulating housing 10.

Figure 4:
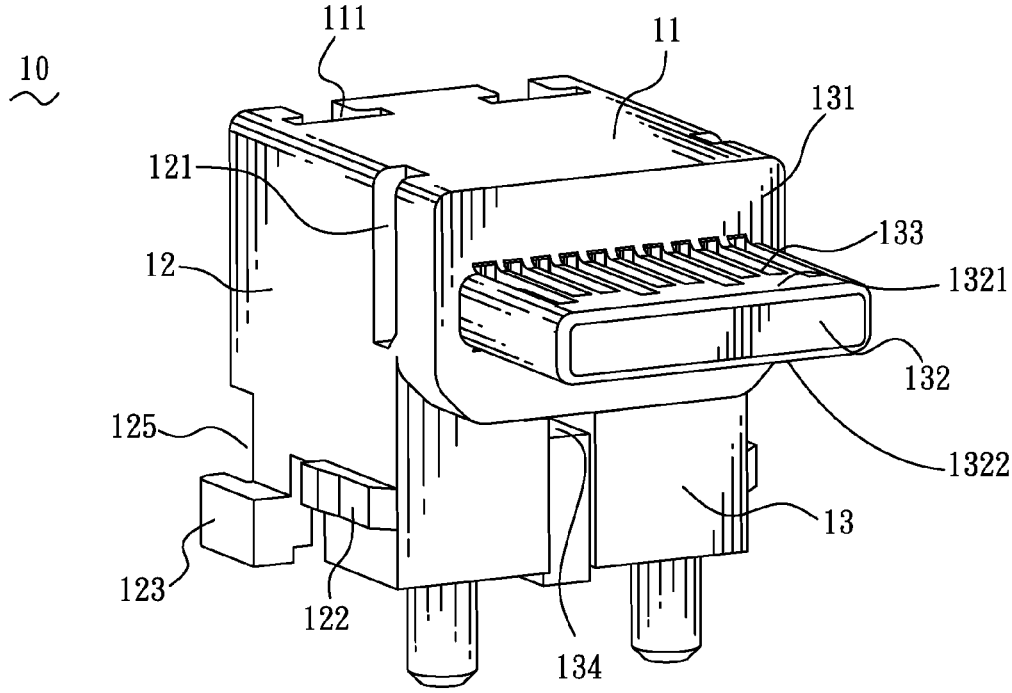
FIG. 4 is a perspective view of an insulating housing of the electrical connector shown in FIG. 1.
Figure 5:
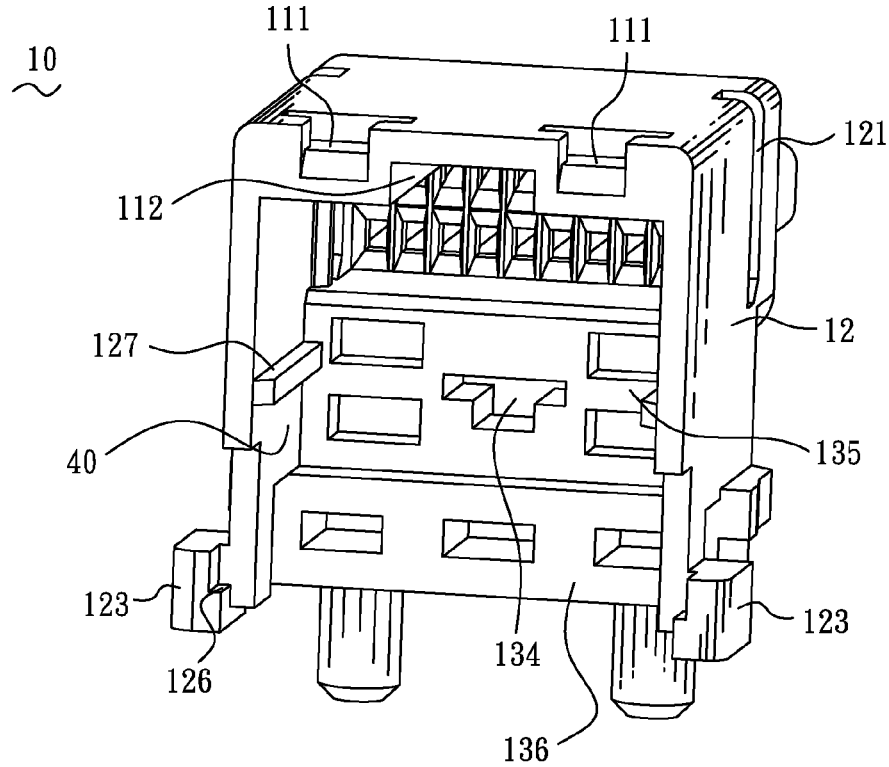
FIG. 5 is a perspective view of the insulating housing of the electrical connector shown in FIG. 4 seen from another direction.

Please refer to FIG. 4 and FIG. 5, the insulating housing 10 includes a rectangular top wall 11, two opposite lateral walls 12 perpendicularly extended downwards from two lateral edges of the top wall 11, a front wall 13 extended downwards from a front edge of the top wall 11 and connected with the lateral walls 12, forming a receiving chamber 40 for receiving the terminal module 20.

The top wall 11 has two T-shaped fixing recesses 111. The fixing recesses 111 are arranged at a rear end of a top surface of the top wall 11 and reach a rear surface of the top wall 11. A bottom surface of the top wall 11 is concaved upwards to form a guiding recess 112. The guiding recess 112 is located between the two fixing recesses 111 and penetrates the rear surface of the top wall 11.

Please refer to FIGS. 3-5, each of the two rectangular lateral walls 12 has a slot 121 at an upper portion thereof, which communicates with the receiving chamber 40 and extends along an upward and downward direction, and a fixing protrusion 122 at a lower portion thereof. The fixing protrusion 122 has a rear portion thereof higher than a front portion to show a step shape. Both the slots 121 and the fixing protrusions 122 are adjacent to the front wall 13. A bottom corner of each of the lateral walls 12 is protruded outwards to form a rectangular bulge 123. The bulge 123 extends rearward and locates below the fixing protrusion 122. A notch 124 is formed between the fixing protrusion 122 and the bulge 123, and communicates with the receiving chamber 40. A lower end of a rear edge of the lateral wall 12 is recessed frontward to form a gap 125. Each of the bulges 123 has a resisting portion 126 at an inner surface thereof, communicating with the corresponding gap 125. Each of the lateral walls 12 is protruded inwards to form a rectangular guiding bar 127 at a middle portion thereof. The guiding bar 127 extends frontward and rearwards.

A rear surface of the front wall 13 is protruded rearwards to form a first supporting portion 135 at a middle portion thereof, and a second supporting portion 136 at a lower portion thereof and rearward of the first supporting portion 135, for supporting the inserted terminal module 20. A front surface of the front wall 13 has an upper portion protruded frontward to form a projecting platform 131, and a through hole 134 under the projecting platform 131. The projecting platform 131 has a middle portion extended frontward to form a rectangular mating portion 132. Two arrays of passageways 133 are formed at a top surface 1321 and a bottom surface 1322 of the mating portion 132, respectively. The passageways 133 extend frontward and rearwards to penetrate through the projecting platform 131 for communicating with the receiving chamber 40 of the insulating housing 10.

Figure 10:
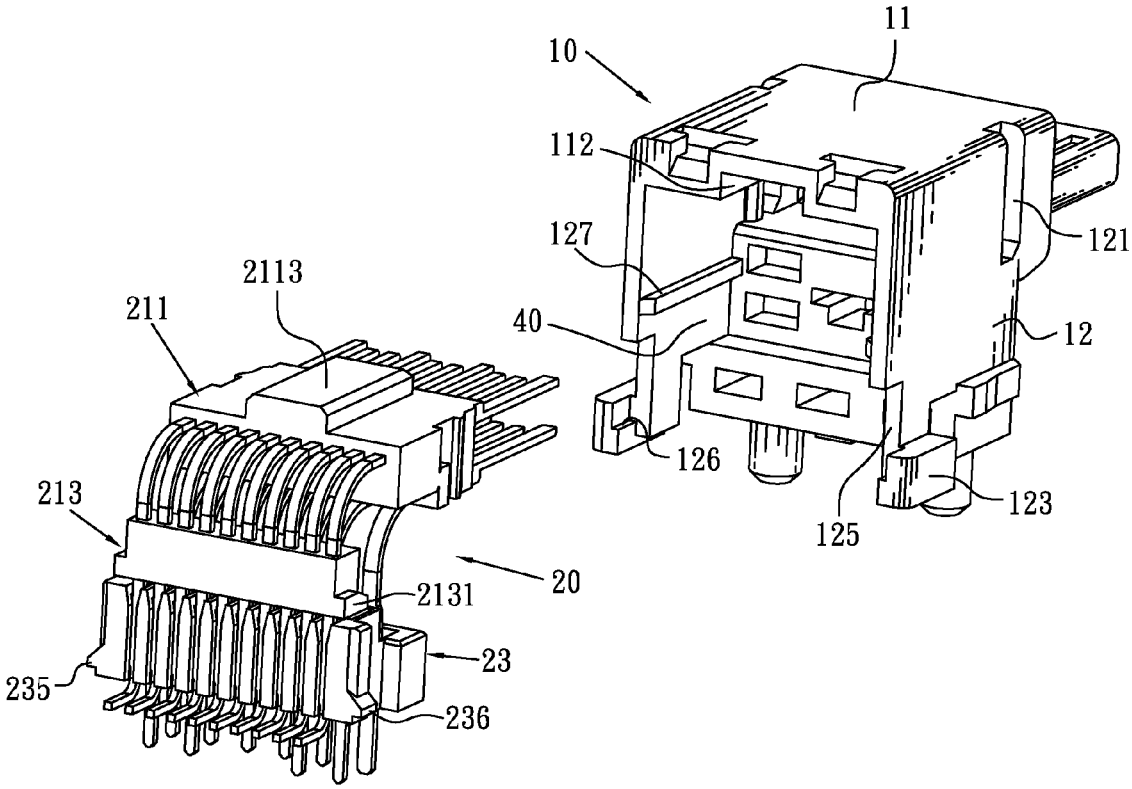
FIG. 10 is a perspective view showing a state that the terminal module of FIG. 8 is located at a rear of the insulating housing of FIG. 5.
Figure 11:
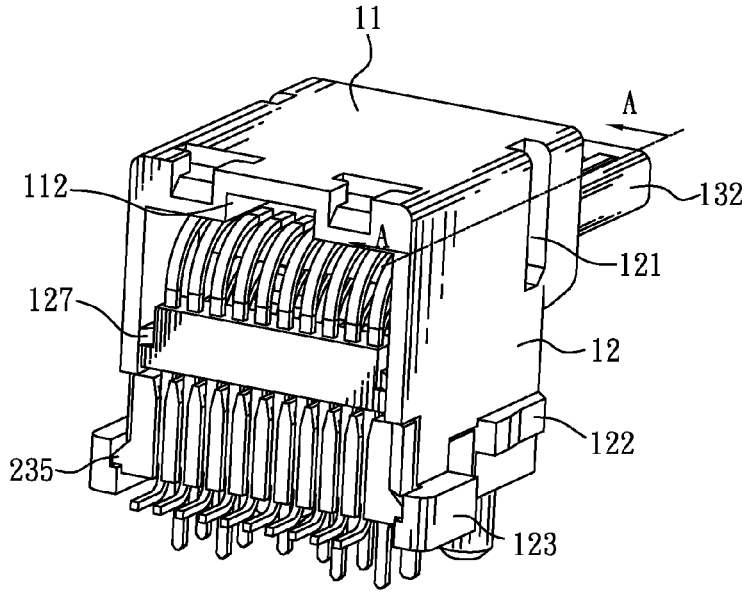
FIG. 11 is a perspective view showing the terminal module of FIG. 8 received in the insulating housing of FIG. 4.
Figure 12:
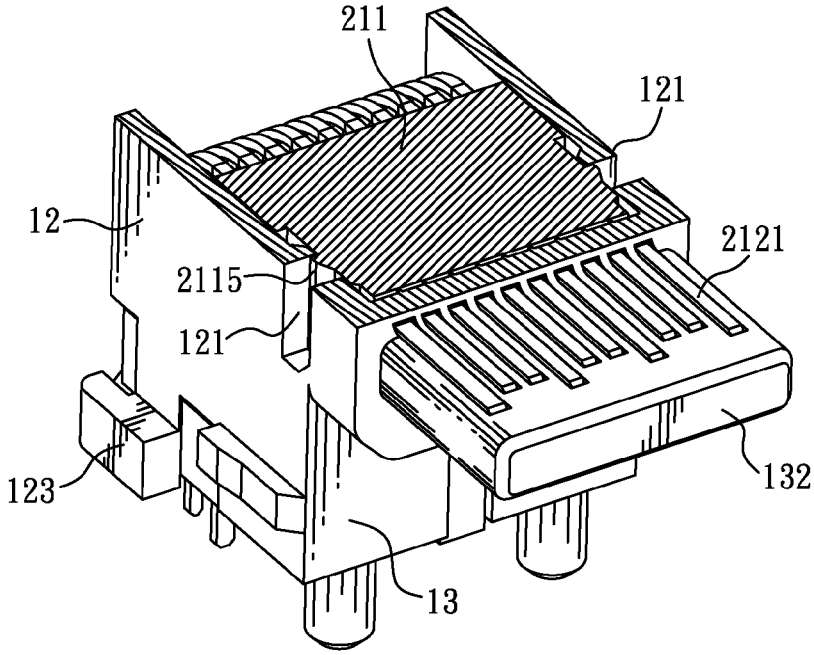
FIG. 12 is a cross-sectional view taken along line A-A shown in FIG. 11.
Figure 13:
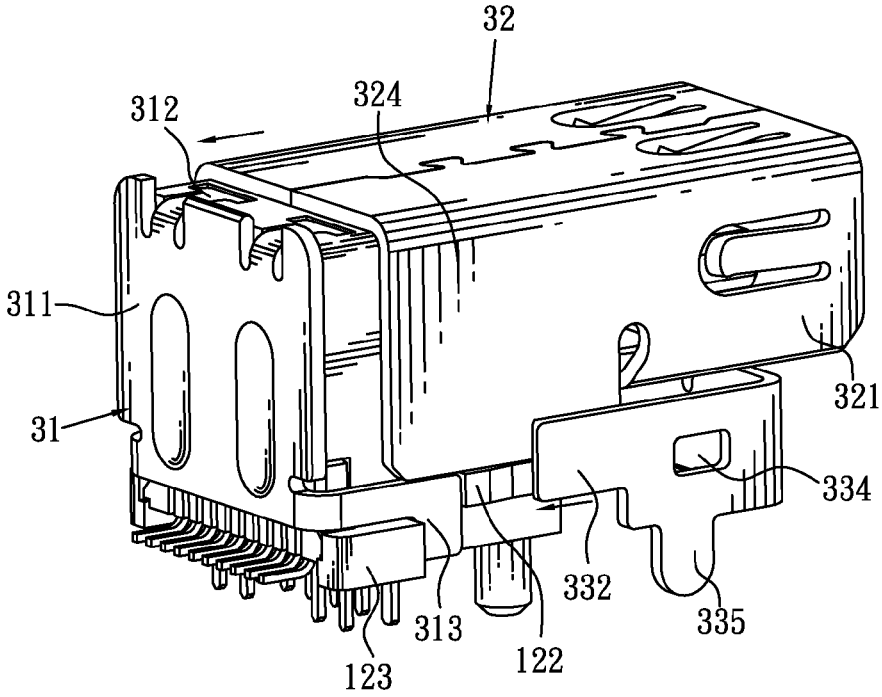
FIG. 13 is a perspective view of the electrical connector shown in FIG. 2, wherein a shielding shell of the electrical connector is not completely assembled to the insulating housing.

Please refer to FIG. 3 and FIG. 10, the terminal module 20, which is inserted into the receiving chamber 40 of the insulating housing 10 from a rear direction, has a module base made of insulating material and a plurality of conductive terminals which are partly received in the module base by means of inserting molding. In this embodiment, the terminal module 20 includes a first terminal module 21 and a second terminal module 22. The first terminal module 21 includes a rectangular first base 211 and a plurality of first conductive terminals 212 restrained by the first base 211. The second terminal module 22 includes a rectangular second base 221 and a plurality of second conductive terminals 222 fixed together by the second base 221. The first base 211 and the second base 221 are made up of the said module base. The first conductive terminals 212 and the second conductive terminals 222 are made up of the said conductive terminals.

Figure 6:
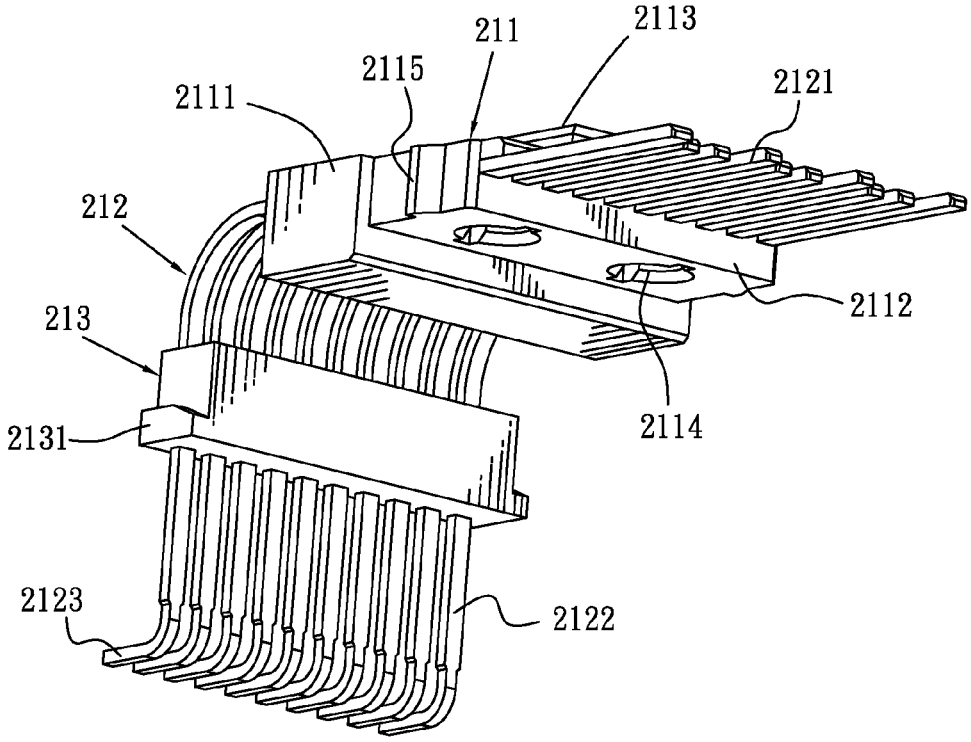
FIG. 6 is a perspective view of a first terminal module of the electrical connector shown in FIG. 3.

Please refer to FIG. 3 and FIG. 6, the first base 211 of the first terminal module 21 has a rectangular body 2111 and a rectangular extending portion 2112 extended frontward from an upper portion of a front surface of the body 2111. A periphery dimension of the extending portion 2112 is smaller than a periphery dimension of the body 2111. In this embodiment, top surfaces of the body 2111 and the extending portion 2112 are flush with each other. A rectangular guiding bump 2113 is protruded upwards from the top surfaces of the body 2111 and the extending portion 2112, corresponding with the guiding recess 112 of the insulating housing 10. The extending portion 2112 has two fixing holes 2114 at a bottom surface thereof. Each of two opposite lateral surfaces of the extending portion 2112 has a first rib 2115. The first conductive terminal 212 has a contacting portion 2121 extending frontward and rearward, a connecting portion 2122 bent downwards from an end of the contacting portion 2121, and a soldering portion 2123 extended oppositely to the contacting portion 2121 from an end of the connecting portion 2122. The contacting portions 2121 pass through the first base 211 in proper order, with rear ends thereof hiding in the base 211 and front ends thereof exceeding out of a front end of the first base 211, to make the first conductive terminals 212 fix together on the first base 211. In order to prevent the first conductive terminals 212 producing deformations in assembly because of the longer connecting portions 2122 thereof, a first assistant element 213 is disposed at the middle of the connecting portions 2122. The first assistant element 213 is a rectangular shape. Lower portions of both lateral surfaces of the first assistant element 213 are protruded outwards to form two sliding portions 2131.

Figure 7:
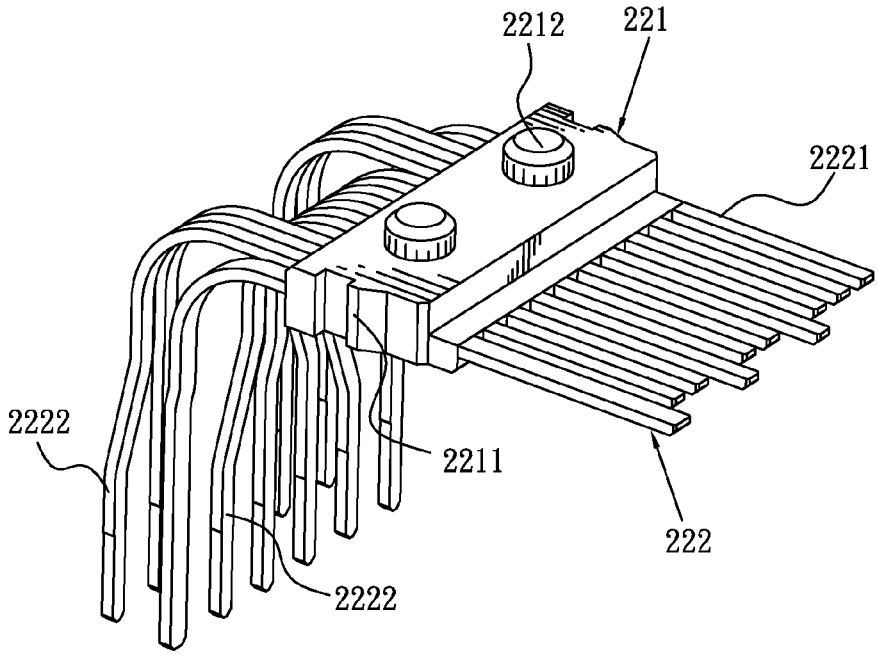
FIG. 7 is a perspective view of a second terminal module of the electrical connector shown in FIG. 3.

Please refer to FIG. 3 and FIG. 7, The second base 221 of the second terminal module 22 has two fixing lumps 2212 at a top surface thereof, corresponding to the fixing holes 2114 of the first base 211. Each of two opposite lateral surfaces of the second base 221 has a second rib 2211 same as the first rib 2115 of the first base 211. The second conductive terminal 222 has a contacting portion 2221 and a connecting portion 2222 bent downwards from an end of the contacting portion 2221, with a free end thereof soldered on an external circuit board (not shown). As same as the first conductive terminals 212, rear ends of the contacting portions 2221 are restrained in the second base 221, and front ends of the contacting portions 2221 are disposed in a row outside the second base 221. The connecting portions 2222 are arranged into two rows to enhance a retentivity between the second conductive terminals 222 and the external circuit board.

Figure 8:
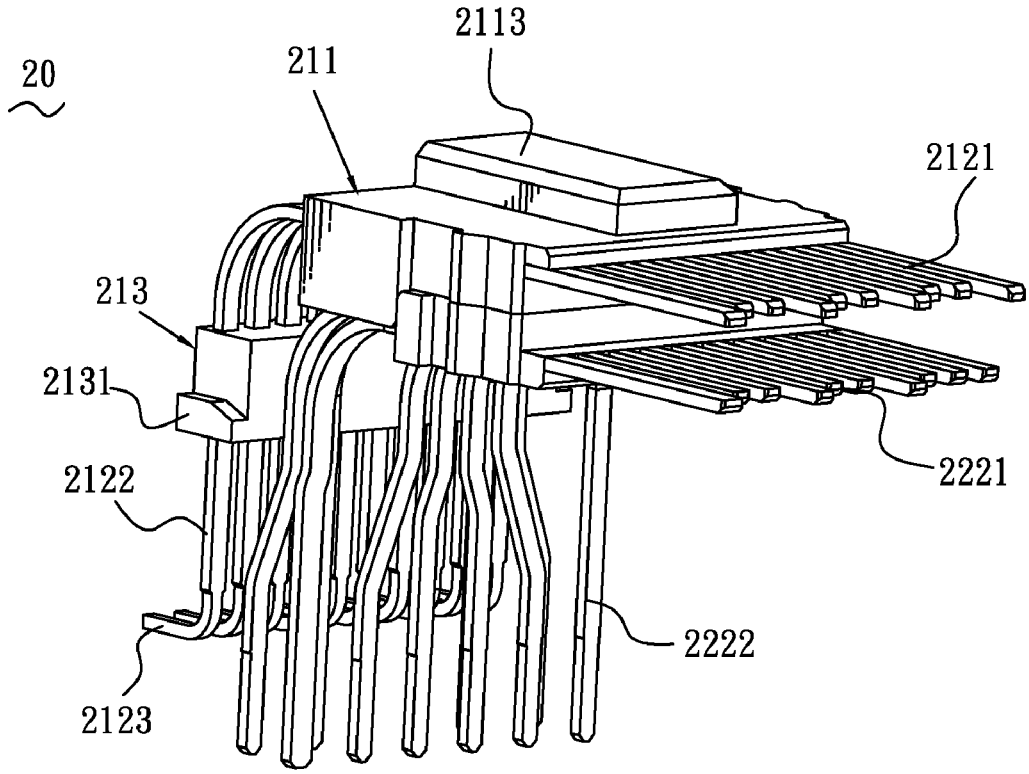
FIG. 8 is a perspective view of a terminal module of the electrical connector shown in FIG. 3.

Please refer to FIGS. 6-8, in assembly, the second terminal module 22 is positioned under the first terminal module 21, by the fixing lumps 2212 of the second base 221 fixed into the fixing holes 2114 of the first base 211. The first rib 2115 and the second rib 2211 are disposed in alignment with each other. The contacting portions 2121, 2221 are arranged into an upper row and a lower row, spaced away from each other. The connecting portions 2122, 2222 are arrayed into three rows, defined with a front row, a middle row and a rear row.

Figure 9:
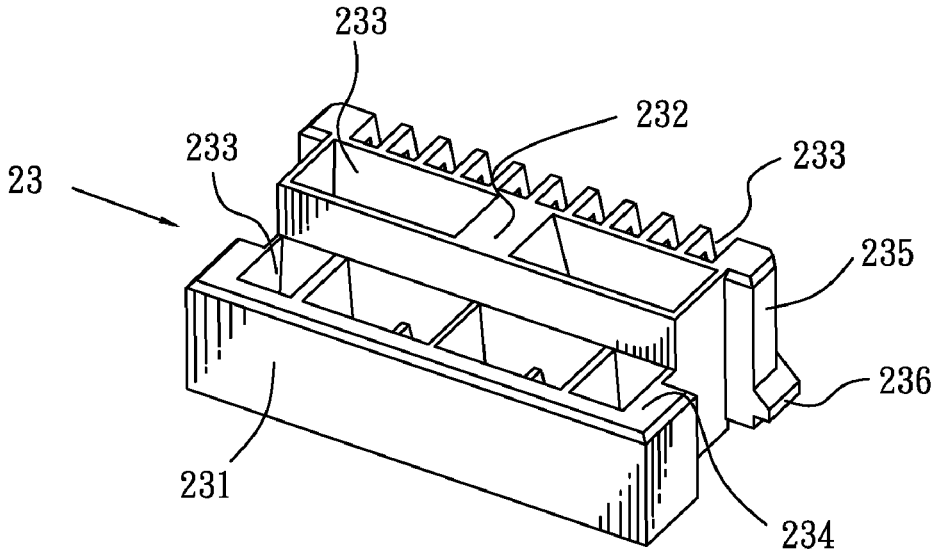
FIG. 9 is a perspective view of a second assistant element of the electrical connector shown in FIG. 3.

Please refer to FIG. 3 and FIG. 9, the terminal module 20 further includes a second assistant element 23 adapted to prevent the connecting portions 2122, 2222 from producing deformations in assembly. The second assistant element 23 has a rectangular semi-closed first receiving casing 231 and a second receiving casing 232 arranged rearward of the first receiving casing 231, with a top surface thereof higher than that of the first receiving casing 231. The first receiving casing 231 and the second receiving casing 232 are partitioned into a plurality of inserting recesses 233 for receiving the front and middle rows of the connecting portions 2122, 2222 of the terminal module 20. An outer surface of a rear wall of the second receiving casing 232 is formed with a plurality of inserting recesses 233 at intervals, for receiving the rear row of the connecting portions 2222. Two lateral surfaces of the first receiving casing 231 are extended oppositely to form two first flanges 234. Rear ends of two opposite lateral surfaces of the second receiving casing 232 are protruded laterally to form two second flanges 235. Each of the second flanges 235 has a bottom end extended outwards to form a stopping bump 236.

Please refer to FIGS. 3-12, in assembly, the terminal module 20 is positioned by the guiding bump 2113 inserted into the guiding recess 112. The sliding portion 2131 of the first assistant element 213 is disposed under the guiding bar 127 and slides into the receiving chamber 40 along a bottom side of the guiding bar 127. The contacting portions 2121, 2221 of the first terminal module 21 and the second terminal module 22 are respectively received into the passageways 133 of the top surface 1321 and the bottom surface 1322 of the mating portion 132. The first ribs 2115 and the second ribs 2211 are jammed in the corresponding slots 121 of the lateral walls 12 to fix the terminal module 20 in the insulating housing 10. The second assistant element 23 receiving the connecting portions 2122, 2222 is received in the receiving chamber 40 and fixed by the first flanges 234 and the stopping bumps 236 of the second flanges 235 respectively coupled with the notches 124 and the resisting portions 126.

Please refer to FIGS. 1-3 and FIG. 13, the shielding shell 30 includes a first metal shell 31, a second metal shell 32 and a third metal shell 33. The first metal shell 31, the second metal shell 32 and the third metal shell 33 may be jointed by Ultrasonic Welding, for achieving a high shielding effectiveness.

The first metal shell 31 has a rectangular base plate 311. The base plate 311 has an upper side bent perpendicularly to form two T-shaped buckling portions 312, spaced away from each other. Bottom ends of two opposite sides of the base plate 311 have two hanging portions 313 of L shape which are located at a same side as the buckling portion 312 with respect to the base plate 311, with oriented ends thereof directing downwards. The base plate 311 is disposed at the rear of the insulating housing 10 to close the receiving chamber 40, with the buckling portions 312 buckled into the fixing recesses 111 of the top wall 11 and the hanging portion 313 hooked the bulge 123 of the lateral wall 12.

The second metal shell 32 has a rectangular frame 321 enclosing a periphery of a front portion of the insulating housing 10. The frame 321 is punched inwards to form a plurality of resilient slices 322 for resisting with an inserting connector (not shown). A top of the frame 321 has a rear portion extended rearward to form a first extending plate 323, covering the top wall 11 of the insulating housing 10. Two opposite sides of the first extending plate 323 are extended downwards to form two second extending plates 324, attached to the two lateral walls 12 of the insulating housing 10, with bottom edges thereof abutting on top edges of the hanging portions 313.

The third metal shell 33 has a front plate 331 and two lateral plates 332 bent rearward from two opposite sides of the front plate 331, for enclosing lower portions of the front wall 13 and the lateral walls 12 of the insulating housing 10 respectively. The front plate 331 has a fixing strip 333 at a top edge thereof for being inserted into the through hole 134 of the front wall 13. Each lateral plate 332 defines a receiving hole 334 for mating with the fixing protrusions 122 of the lateral walls 12. A grounding portion 335 is extended downwards from a bottom edge of each lateral plate 332, adjacent to the front plate 331, for being grounded. A rear portion of the lateral plate 332 is located on the bulge 123 of the lateral wall 12 of the insulating housing 10, enclosing a junction of the first metal 31 and the second metal shell 32, which can achieve an excellent shielding effectiveness.

As describe above, the first conductive terminals 212 and the second conductive terminals 222 are restrained together by the first base 211 and the second base 221 respectively, forming the first terminal module 21 and the second terminal module 22. The first terminal module 21 and the second terminal module 22 are piled with each other to make the contacting portions 2121, 2221 form two rows, which is capable of being inserted into the corresponding passageways 133 of the mating portion 132 of the insulating housing 10 simultaneously, in assembly, for simplifying the assembly process. Furthermore, the simple structure of the insulating housing 10 is easy to manufacture and reduces the manufacture time and cost.

Furthermore, the present invention is not limited to the embodiment described above; various additions, alterations and the like may be made within the scope of the present invention by a person skilled in the art. For example, respective embodiments may be appropriately combined.

What is claimed is:

1. An electrical connector, comprising:

an insulating housing, the insulating housing including a rectangular top wall, two facing lateral walls connected to two opposite sides of the top wall, a front wall extended downwards from a front side of the top wall and connected with the two lateral walls to form a receiving chamber, the front wall having a portion extended frontward to form a mating portion, the mating portion having a plurality of passageways extending frontward and rearward for communicating with the receiving chamber on a top surface and a bottom surface respectively;

a first terminal module having a plurality of first conductive terminals and a first base for restraining the first conductive terminals, the first conductive terminals having contacting portions extended outside the first base and arranged side by side to form one row for being received in the passageways defined on the top surface;

a second terminal module disposed under the first terminal module, the second terminal module having a plurality of second conductive terminals and a second base for restraining the second conductive terminals, the second conductive terminals having contacting portions extended outside the second base and arranged side by side to form one row spaced from the row of the contacting portions of the first conductive terminals for being received in the passageways defined on the bottom surface; and a shielding shell enclosing a periphery of the insulating housing, the shielding shell including a first metal shell, a second metal shell and a third metal shell, the first metal shell having a base plate disposed at a rear of the insulating housing to close the receiving chamber, the base plate having an upper side bent perpendicularly to form two T-shaped buckling portions spaced away from each other, bottom ends of two opposite sides of the base plate having two hanging portions of L shape which are located at a same side as the buckling portions with respect to the base plate with oriented ends thereof directing downwards;

wherein the first base is fixed on the second base to make the first terminal module and the second terminal module received in the receiving chamber of the housing at one time.

2. The electrical connector as claimed in claim 1, wherein the contacting portion of each of the first conductive terminals is extended frontward and rearward, a connecting portion is bent downwards from a free end of the contacting portion, a soldering portion is extended opposite to the contacting portion from a free end of the connecting portion, and the first base is located at ends of the contacting portions adjacent to the connecting portions.

3. The electrical connector as claimed in claim 2, wherein the first terminal module further comprises a rectangular first assistant element which is fixed at middle portions of the connecting portions to prevent deformation.

4. The electrical connector as claimed in claim 3, wherein two opposite sides of the first assistant element are protruded outwards to form sliding portions, an inner surface of each lateral wall of the insulating housing is protruded inwards to form a guiding bar, and the sliding portions slide under the guiding bars in assembly.

5. The electrical connector as claimed in claim 1, wherein each of the second conductive terminals has the contacting portion extending frontward and rearward and a connecting portion bent downwards from a free end of the connecting portion, and the second base is disposed at ends of the contacting portions adjacent to the connecting portions.

6. The electrical connector as claimed in claim 1, wherein the second base and the first base are engaged with each other.

7. The electrical connector as claimed in claim 6, wherein the first base and the second base are substantially rectangular, the first base has two fixing holes at a bottom surface thereof, and the second base has two fixing lumps at a top surface thereof corresponding to the fixing holes.

8. The electrical connector as claimed in claim 1, wherein a top surface of the first base has a guiding bump, and the top wall of the insulating housing defines a guiding recess at a bottom surface thereof corresponding with the guiding bump for guiding the first base to slide in the receiving chamber.

9. The electrical connector as claimed in claim 1, wherein each of two opposite lateral surfaces of the first base has a first rib extending perpendicular to an extending direction of the contacting portions of the first conductive terminals, and each of the lateral walls of the insulating housing is formed with a slot for receiving the first rib.

10. The electrical connector as claimed in claim 9, wherein each of two opposite lateral surfaces of the second base has a second rib extending perpendicular to an extending direction of the contacting portions of the second conductive terminals, and the second rib is disposed in alignment with the first rib when the first terminal module is fixed with the second terminal module and collectively received in the slot.

11. The electrical connector as claimed in claim 1, wherein the second metal shell has a rectangular frame enclosing a periphery of a front portion of the insulating housing, the rectangular frame is punched inwards with a plurality of resilient slices thereon, a top of the rectangular frame has a rear portion extended rearward to form a first extending plate, and two opposite sides of the first extending plate are extended downwards to form two second extending plates attached to the two lateral walls of the insulating housing.

12. The electrical connector as claimed in claim 1, wherein the third metal shell has a front plate and two lateral plates bent rearward from two opposite sides of the front plate, the front plate has a fixing strip at a top edge thereof, and a grounding portion is extended downwards from a bottom edge of each of the two lateral plates adjacent to the front plate for grounding.

13. An electrical connector, comprising:

an insulating housing, the insulating housing including a rectangular top wall, two facing lateral walls connected to two opposite sides of the top wall, a front wall extended downwards from a front side of the top wall and connected with the two lateral walls to form a receiving chamber, the front wall having a portion extended frontward to form a mating portion, the mating portion having a plurality of passageways extending frontward and rearward for communicating with the receiving chamber on a top surface and a bottom surface respectively;

a first terminal module having a plurality of first conductive terminals and a first base for restraining the first conductive terminals, the first conductive terminals having contacting portions extended outside the first base and arranged side by side to form one row for being received in the passageways defined on the top surface;

a second terminal module disposed under the first terminal module, the second terminal module having a plurality of second conductive terminals and a second base for restraining the second conductive terminals, the second conductive terminals having contacting portions extended outside the second base and arranged side by side to form one row spaced from the row of the contacting portions of the first conductive terminals for being received in the passageways defined on the bottom surface; and a shielding shell enclosing a periphery of the insulating housing, the shielding shell including a first metal shell, a second metal shell and a third metal shell, the second metal shell having a rectangular frame enclosing a periphery of a front portion of the insulating housing, the rectangular frame being punched inwards with a plurality of resilient slices thereon, a top of the rectangular frame having a rear portion extended rearward to form a first extending plate, and two opposite sides of the first extending plate being extended downwards to form two second extending plates attached to the two lateral walls of the insulating housing;

wherein the first base is fixed on the second base to make the first terminal module and the second terminal module received in the receiving chamber of the housing at one time.

14. The electrical connector as claimed in claim 13, wherein the contacting portion of each of the first conductive terminals is extended frontward and rearward, a connecting portion is bent downwards from a free end of the contacting portion, a soldering portion is extended opposite to the contacting portion from a free end of the connecting portion, the first base is located at ends of the contacting portions adjacent to the connecting portions, and the first terminal module further comprises a rectangular first assistant element which is fixed at middle portions of the connecting portions to prevent deformation.

15. The electrical connector as claimed in claim 14, wherein two opposite sides of the first assistant element are protruded outwards to form sliding portions, an inner surface of each lateral wall of the insulating housing is protruded inwards to form a guiding bar, and the sliding portions slide under the guiding bars in assembly.

16. The electrical connector as claimed in claim 13, wherein a top surface of the first base has a guiding bump, and the top wall of the insulating housing defines a guiding recess at a bottom surface thereof corresponding with the guiding bump for guiding the first base to slide in the receiving chamber.

17. The electrical connector as claimed in claim 13, wherein each of two opposite lateral surfaces of the first base has a first rib extending perpendicular to an extending direction of the contacting portions of the first conductive terminals, and each of the lateral walls of the insulating housing is formed with a slot for receiving the first rib.

18. The electrical connector as claimed in claim 17, wherein each of two opposite lateral surfaces of the second base has a second rib extending perpendicular to an extending direction of the contacting portions of the second conductive terminals, and the second rib is disposed in alignment with the first rib when the first terminal module is fixed with the second terminal module and collectively received in the slot.

19. The electrical connector as claimed in claim 13, wherein the third metal shell has a front plate and two lateral plates bent rearward from two opposite sides of the front plate, the front plate has a fixing strip at a top edge thereof, and a grounding portion is extended downwards from a bottom edge of each of the two lateral plates adjacent to the front plate for grounding.

20. An electrical connector, comprising:

an insulating housing, the insulating housing including a rectangular top wall, two facing lateral walls connected to two opposite sides of the top wall, a front wall extended downwards from a front side of the top wall and connected with the two lateral walls to form a receiving chamber, the front wall having a portion extended frontward to form a mating portion, the mating portion having a plurality of passageways extending frontward and rearward for communicating with the receiving chamber on a top surface and a bottom surface respectively;

a first terminal module having a plurality of first conductive terminals and a first base for restraining the first conductive terminals, the first conductive terminals having contacting portions extended outside the first base and arranged side by side to form one row for being received in the passageways defined on the top surface;

a second terminal module disposed under the first terminal module, the second terminal module having a plurality of second conductive terminals and a second base for restraining the second conductive terminals, the second conductive terminals having contacting portions extended outside the second base and arranged side by side to form one row spaced from the row of the contacting portions of the first conductive terminals for being received in the passageways defined on the bottom surface; and a shielding shell enclosing a periphery of the insulating housing, the shielding shell including a first metal shell, a second metal shell and a third metal shell, the third metal shell having a front plate and two lateral plates bent rearward from two opposite sides of the front plate, the front plate having a fixing strip at a top edge thereof, and a grounding portion being extended downwards from a bottom edge of each of the two lateral plates adjacent to the front plate for grounding;

wherein the first base is fixed on the second base to make the first terminal module and the second terminal module received in the receiving chamber of the housing at one time.

* * * * *